US011612229B1

(12) United States Patent
Pao et al.

(10) Patent No.: US 11,612,229 B1
(45) Date of Patent: Mar. 28, 2023

(54) LONG HANDLED MOTORIZED TOENAIL TRIMMER

(71) Applicants: Jonathan Pao, Boston, MA (US); Joshua Zhu, Brooklyn, NY (US); Stacey Wong, New Hyde Park, NY (US); Jialin Ke, Brooklyn, NY (US); Jordan Gorelick, Woodbridge, CT (US)

(72) Inventors: Jonathan Pao, Boston, MA (US); Joshua Zhu, Brooklyn, NY (US); Stacey Wong, New Hyde Park, NY (US); Jialin Ke, Brooklyn, NY (US); Jordan Gorelick, Woodbridge, CT (US)

(73) Assignee: Pedicure, Inc., Ithaca, NY (US)

( * ) Notice: Subject to any disclaimer, the term of this patent is extended or adjusted under 35 U.S.C. 154(b) by 79 days.

(21) Appl. No.: 16/860,298

(22) Filed: Apr. 28, 2020

Related U.S. Application Data

(63) Continuation of application No. 16/860,209, filed on Apr. 28, 2020, now Pat. No. 11,382,397.
(Continued)

(51) Int. Cl.
*A45D 29/02* (2006.01)

(52) U.S. Cl.
CPC ..... *A45D 29/02* (2013.01); *A45D 2029/026* (2013.01)

(58) Field of Classification Search
CPC ..... A45D 29/00; A45D 29/02; A45D 29/05; A45D 29/06; A45D 29/14; A45D 29/18;
(Continued)

(56) References Cited

U.S. PATENT DOCUMENTS 527,240 A 10/1894 Garies
857,790 A 6/1907 Carroll
(Continued)

FOREIGN PATENT DOCUMENTS

CA 670052 9/1963
DE 2752179 6/1979
(Continued)

OTHER PUBLICATIONS

ClipDifferent, Automatic Fingernail Clippers, ClipDifferent Pro $149, May 16, 2020, available at: https://clipdifferent.com/product/professional-automatic-fingernail-clipper/.
(Continued)

*Primary Examiner* — Amy R Sipp
*Assistant Examiner* — Karim Asqiriba
(74) *Attorney, Agent, or Firm* — Thomas A. O'Rourke; Bodner & O'Rourke, LLP

(57) ABSTRACT

A toenail trimmer is configured to aid elderly and flexibility-challenged individuals, and includes: a housing with an opening; a cutting member mounted within the housing with a portion proximate to the opening; a motor to drive the cutting member to remove a portion of a toenail inserted through the housing opening; and a shaft, with the housing positioned proximate to a first end of the shaft. The shaft includes a support member, such as a cuff, that is configured to releasably secure a first portion of the shaft to the user's upper arm, and an ergonomic handle portion configured for grasping by the user's hand. The ergonomic handle portion and the support member provide stable support for the toe nail trimmer at two positions with respect to the user's arm during use of the toe nail trimmer. The handle may cooperate with a base to provide support/guidance thereto.

8 Claims, 16 Drawing Sheets

Related U.S. Application Data

(60) Provisional application No. 62/840,818, filed on Apr. 30, 2019.

(58) Field of Classification Search
CPC ..... A45D 29/023; A45D 2029/026; A45D 29/04; A45D 29/07; A45D 29/11; A45D 29/12; A45D 29/16; A45D 29/17; A45D 29/20; A45D 29/22; A45D 31/00; A45D 2031/005
USPC ..... 30/26–30
See application file for complete search history.

(56) References Cited

U.S. PATENT DOCUMENTS

| | | | | | |
|---|---|---|---|---|---|
| 1,556,510 | A * | 10/1925 | King | G02B 25/02 | 359/803 |
| 1,892,867 | A | 1/1933 | Burr | | |
| 2,532,370 | A | 12/1950 | Perrill | | |
| 2,880,737 | A | 4/1959 | Tone | | |
| 3,216,034 | A | 11/1965 | Johnson | | |
| 3,596,667 | A | 8/1971 | Buercklin | | |
| 3,613,696 | A | 10/1971 | Paule | | |
| 4,103,694 | A | 8/1978 | Burian | | |
| 4,207,880 | A | 6/1980 | Zinkovich | | |
| 4,294,268 | A | 10/1981 | Kitrell | | |
| 4,328,819 | A * | 5/1982 | Haas | A45D 29/02 | 132/73.6 |
| 4,408,623 | A | 10/1983 | Murray | | |
| 4,683,897 | A | 8/1987 | McBride | | |
| 4,753,253 | A | 6/1988 | Hutson | | |
| 4,847,994 | A | 7/1989 | Dunn | | |
| 4,854,334 | A | 8/1989 | Su | | |
| 4,893,406 | A | 1/1990 | Larson | | |
| 4,956,915 | A | 9/1990 | Anderson | | |
| 5,123,430 | A | 6/1992 | Davidovitz | | |
| 5,357,677 | A | 10/1994 | West | | |
| 5,546,658 | A | 8/1996 | MacLeod | | |
| 5,749,377 | A | 5/1998 | Desario | | |
| 5,775,340 | A * | 7/1998 | Rains | A45D 29/02 | 132/73.5 |
| 5,864,746 | A | 1/1999 | Chang | | |
| 5,931,167 | A * | 8/1999 | Coleman | A45D 26/0066 | 132/73.5 |
| 6,050,270 | A | 4/2000 | Tyshenko | | |
| 6,220,251 | B1 | 4/2001 | Jeong | | |
| 6,325,069 | B1 * | 12/2001 | Heims | A45D 29/22 | 132/73 |
| 6,539,632 | B2 | 4/2003 | Anctil | | |
| 6,601,587 | B2 | 8/2003 | Shaw | | |
| 6,799,579 | B2 | 10/2004 | Joseph | | |
| 6,865,812 | B1 * | 3/2005 | Martin, Jr. | A45D 29/18 | 30/276 |
| 7,188,628 | B2 | 3/2007 | Shubert | | |
| 7,954,242 | B1 | 6/2011 | Brizan | | |
| 8,201,565 | B2 | 6/2012 | Fernandez | | |
| 8,356,414 | B2 | 1/2013 | Wendorf | | |
| 8,472,129 | B1 * | 6/2013 | Trask | G02B 25/005 | 359/803 |
| 8,667,691 | B2 | 3/2014 | Gibbs | | |
| 9,486,051 | B1 | 11/2016 | Robinson | | |
| 9,833,053 | B1 * | 12/2017 | Williams | A45D 29/00 | |
| D852,421 | S | 6/2019 | Solitt | | |
| 2002/0092170 | A1 * | 7/2002 | Anctil | A45D 29/02 | 30/28 |
| 2002/0134395 | A1 | 9/2002 | Hermiz | | |
| 2003/0094183 | A1 * | 5/2003 | Shaw | A45D 29/18 | 132/75.3 |
| 2004/0045568 | A1 | 3/2004 | Abbott | | |
| 2005/0103356 | A1 | 5/2005 | Edman | | |
| 2008/0066771 | A1 | 3/2008 | Pinchuk | | |
| 2008/0296447 | A1 * | 12/2008 | Peterson | A61B 17/54 | 248/171 |
| 2009/0119922 | A1 | 5/2009 | Doyle | | |
| 2009/0223055 | A1 * | 9/2009 | Wendorf | A45D 29/02 | 30/28 |
| 2009/0229622 | A1 | 9/2009 | Malin | | |
| 2011/0226270 | A1 | 9/2011 | Rivera | | |
| 2015/0173484 | A1 * | 6/2015 | Fitzsimons | A45D 29/02 | 132/200 |
| 2016/0270505 | A1 | 9/2016 | Downey | | |
| 2018/0000221 | A1 | 1/2018 | Adem | | |
| 2018/0199689 | A1 * | 7/2018 | Carton | A45D 29/02 | |
| 2019/0090608 | A1 | 3/2019 | McMullen | | |
| 2020/0154847 | A1 * | 5/2020 | Fields | A45D 29/02 | |
| 2021/0321741 | A1 * | 10/2021 | Schulz | A45D 29/02 | |

FOREIGN PATENT DOCUMENTS

| | | |
|---|---|---|
| DE | 10038445 | 2/2002 |
| EP | 1607019 | 12/2005 |
| EP | 1716799 | 5/2010 |
| FR | 2635447 | 2/1990 |
| GB | 2191396 A | 12/1987 |
| GB | 2375044 A | 11/2002 |
| GB | 2427136 A | 12/2006 |
| WO | WO 91/19436 | 12/1991 |
| WO | WO 2008/028020 | 3/2008 |

OTHER PUBLICATIONS

Press Fit Forces Stress Design Calculator, Jun. 18, 2018, available at: www.engineersedge.com/calculators/machine-design/press-fit/press-fit.htm.

"Three General Types of Fit," available at www.mmto.org/dclark/Reports/Encoder%20Upgrade/fittolerences%20%5BRead-Only%5D.pdf., Jul. 8, 2019.

"Engineering Fit," available at: https://en.wikipedia.org/wiki/Engineering_fit, Jul. 8, 2019.

"Foot Shape Ancestry: What Your Toes Can Tell You," Nov. 15, 2018, avalable at: https://blog.genealogybank.com/foot-shape-ancestry-what-your-toes-can-tell-you.html.

* cited by examiner

FIG. 4
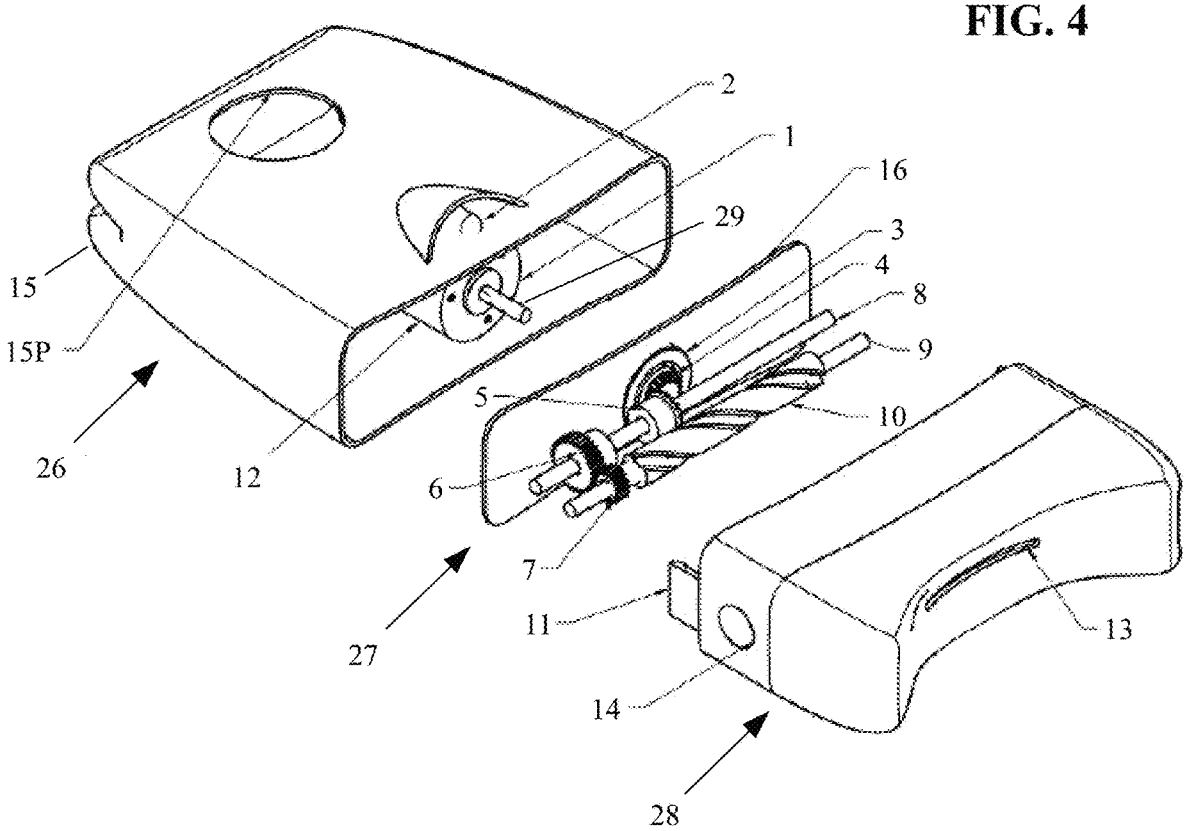
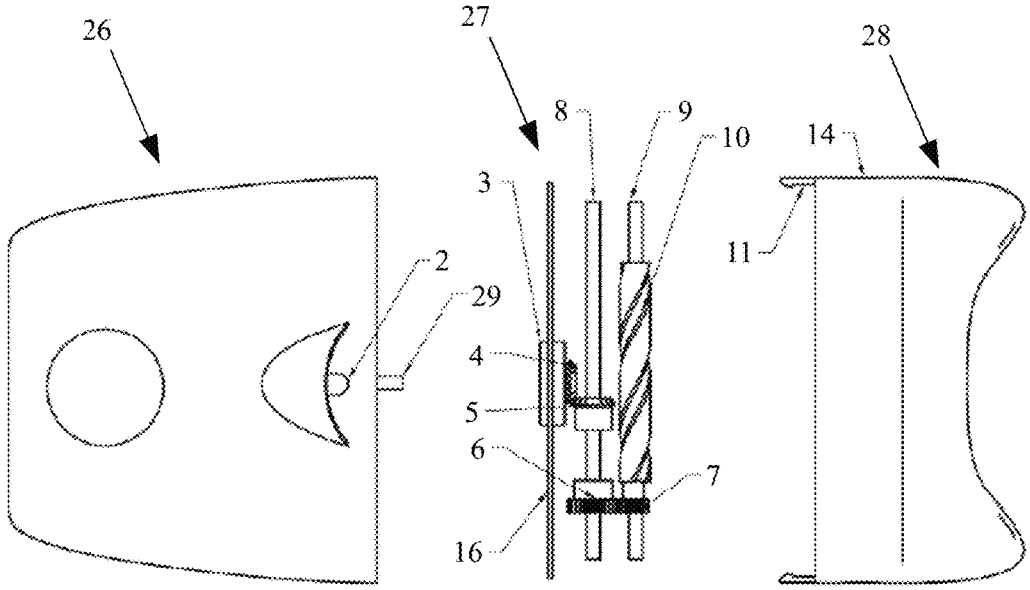
FIG. 5

LONG HANDLED MOTORIZED TOENAIL TRIMMER

CROSS REFERENCES TO RELATED APPLICATIONS

This application is a continuation of U.S. application Ser. No. 16/860,209, filed on Apr. 28, 2020, which claims priority on U.S. Provisional Application Ser. No. 62/840,818, filed on Apr. 30, 2019, the disclosures of which are incorporated herein by reference.

BACKGROUND OF INVENTION

1. Field of Invention

The present invention relates to toenail grooming for the elderly and other flexibility challenged persons (e.g., pregnant women) and/or physically disabled individuals (e.g., a paraplegic) who would otherwise experience difficulty in utilizing traditional toenail trimmers, and more particularly to the field of long-handled toenail clippers with motorized nail trimming apparatus.

2. Description of the Prior Art

A traditional nail clipper is designed for convenience of clipping fingernails but may be difficult to use to clip toenails for an elderly person, even for the larger sized nail clippers intended for use on a person's toenails. When clipping toenails, the user usually has to manipulate his or her body into various positions such as bending over one's legs, retracting one's legs to bend at the knee, or lifting the foot to rest on a table or chair. These positions are very uncomfortable or may be impossible for those who are elderly, disabled, ill, obese or pregnant. These users risk injury when attempting to cut their toenails because of poor body positioning, which users may therefore be forced to rely on help from family, friends, and other caregivers.

Also, toenail trimming is conventionally performed with small handheld clippers which require exertion of physical force to cut through toenail keratin. This aspect of the traditional method of toenail clipping serves as an additional obstacle for the elderly, and the handicapped, who may lack the required physical strength. Further exacerbating these problems are the limited vision, and decreased fine motor skills to accurately position the trimmer. The factors may contribute to an increased prevalence of foot fungus, nail deformation, and ingrown toenails among individuals whom are unable to address their difficulties and maintain proper toenail care.

A number of nail clipper devices have been disclosed. An example of such a device is the Electrically Automated Nail-Clipping Device, issued as U.S. Pat. No. 4,328,819, in the name of Everett L. Haas (Haas patent). The Haas patent utilizes a vibrating blade which severs nails as the blade moves back and forth. The Haas nail trimmer and other similar nail trimmers seek to address the physical limitations of individuals with deficient strength and limited fine motor skills. However, although the abrasive grit in these devices are susceptible to being worn down with time, no method is disclosed to extract and replace the grit from the internal portions of the device. Additionally, these devices provide little support for elderly users that have problems with maneuverability and flexibility.

Some toe nail trimmers have further included an extension arm in their designs to offer a method to reach the lower extremities of the elderly user in the face of limited flexibility and maneuverability. An example of such a device is the Nail Trimmer, issued as U.S. Pat. No. 6,865,812, in the name of Roy C. Martin, Jr. (Martin patent). While the Martin patent, and similar devices, address the mobility issue with the extension arm, the utilization of the feature remains quite rudimentary and offers no real support for the device with respect to the arm of the user, apart from merely being grasped by a single hand, which requires an undue amount of hand strength and dexterity to both hold and manipulate the device.

There is a long felt but unmet need in the art of toe nail trimmers for apparatus that provides greater assistance for individuals with physical deficiencies, particularly with respect to providing support for the users hand and/or arm during the process, which may eliminate ineffective nail trimming and eliminate the cuts and bruises that may result from such ineffective nail trimming. There is also a long felt but unmet need in the art of toe nail trimmers for apparatus that permits toe nails to be trimmed in a safe and easy manner, while permitting the individual to assume a comfortable position throughout the toenail trimming process.

The apparatus disclosed herein addresses the deficiencies with respect to prior art toe nail trimmers.

OBJECTS OF THE INVENTION

It is an object of the invention to provide a device that may be used to assist a person that has reduced arm strength and/or dexterity to more easily trim his/her toenails.

It is another object of the invention to provide a device that may be used by the elderly and flexibility challenged individuals to trim his/her toenails without having to bend excessively to reach the toenails.

It is an object of the invention to provide a device that may be used by the elderly and flexibility challenged individuals to more safely trim his/her toenails.

It is another object of the invention to provide a toenail trimmer device that may be used by the elderly and flexibility challenged individuals to trim his/her toenails, without the use of clippers or shears that may inadvertently cause damage to the sides of the user's toes.

It is a further object of the invention to provide a toenail trimming apparatus that may provide enhanced support with respect to a user's arm for trimming of his/her toenails.

It is another object of the invention to provide a toenail trimming apparatus that may have two points of support with respect to the user's arm while trimming of his/her toenails.

It is also an object of the invention to provide a toenail trimming apparatus that may have a long handle, a portion of which may be particularly configured to be ergonomically grasped by the user's hand, while a distal end of the handle may be particularly configured to releasably couple to the user's forearm or upper arm, to assist in holding, supporting, and guiding the trimmer into contact with the user's toenails.

It is another object of the invention to provide a base that may be used to support a user's foot, while a toenail trimming device is used to trim his/her toenails.

It is also an object of the invention to provide a base that may be used to support a user's foot, and which may co-act with a particularly configured long-handled toenail trimming device, to assist elderly and flexibility-challenged individuals to more easily trim his/her toenails.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A first embodiment of a toenail trimming apparatus disclosed herein includes a long handled trimmer and a particularly configured base that the long handle trimmer may cooperate with for the user to more easily trim his or her toenails.

The long handled trimmer may include an extension arm, which may telescope or disassemble in sections, a motorized nail trimmer attached proximate to one end of the arm, an arm cuff attached proximate to the other end of the arm, and a handle extending laterally away from the arm between the two ends. The combination of the cuff and the handle provide greater ease in maneuvering of the device by an elderly user who may have diminished motor skills/dexterity.

In one embodiment, the motorized trimmer may use a rotating shaft upon which is formed a trimmer surface that is striated and designed to shave the toenail and not cut the skin.

In another embodiment, the motorized trimmer may use a rotating flexible sanding belt, with an amount of grit to allow for shaving of the toenail. The attached motorized nail trimmer may have a unique shape for the housing on the trimming end that simultaneously enables separation of two toes that allows for trimming of one toe without adjacent toes getting in the way.

The base acts not only as a footrest, but also as a means for assisting in maneuvering of the long handled trimmer, as it may include a curved slot that serves as a track that receives and guides a lower end of the long handled trimmer.

The base being so configured to cooperate with the long handled trimmer may also serve to support the weight of the trimmer, and alleviate the need for the elderly user's arm to have to support it during use, even where the device may be considered lightweight with respect to an arm of a younger/stronger user (e.g., a pregnant woman).

The base may also serve in stabilizing and securing the long handled trimmer during the trimming process. The base may be adjustable to different heights and angles to accommodate a variety of seating positions, and may include a light and magnifier This apparatus allows for disassembly and reassembly of its components which provides convenience for storing as well as making it easier for users to reach and set up the apparatus.

Another embodiment of a toenail trimming apparatus disclosed herein may only include a particularly formed long handled trimmer with a cuff and handle, which is intended to be used without the base.

A third embodiment of the toenail trimming apparatus disclosed herein may only include the toenail trimmer itself, used independently of the long handle shaft and foot support base.

BRIEF DESCRIPTION OF THE DRAWINGS

The description of the various example embodiments is explained in conjunction with appended drawings, in which:

FIG. 4 is an exploded perspective view of the component parts of the motorized nail trimmer of the long handled nail trimmer device shown in FIG. 1.

FIG. 5 is a top view of the component parts shown in FIG. 4.

DETAILED DESCRIPTION OF THE INVENTION

Figure 1:
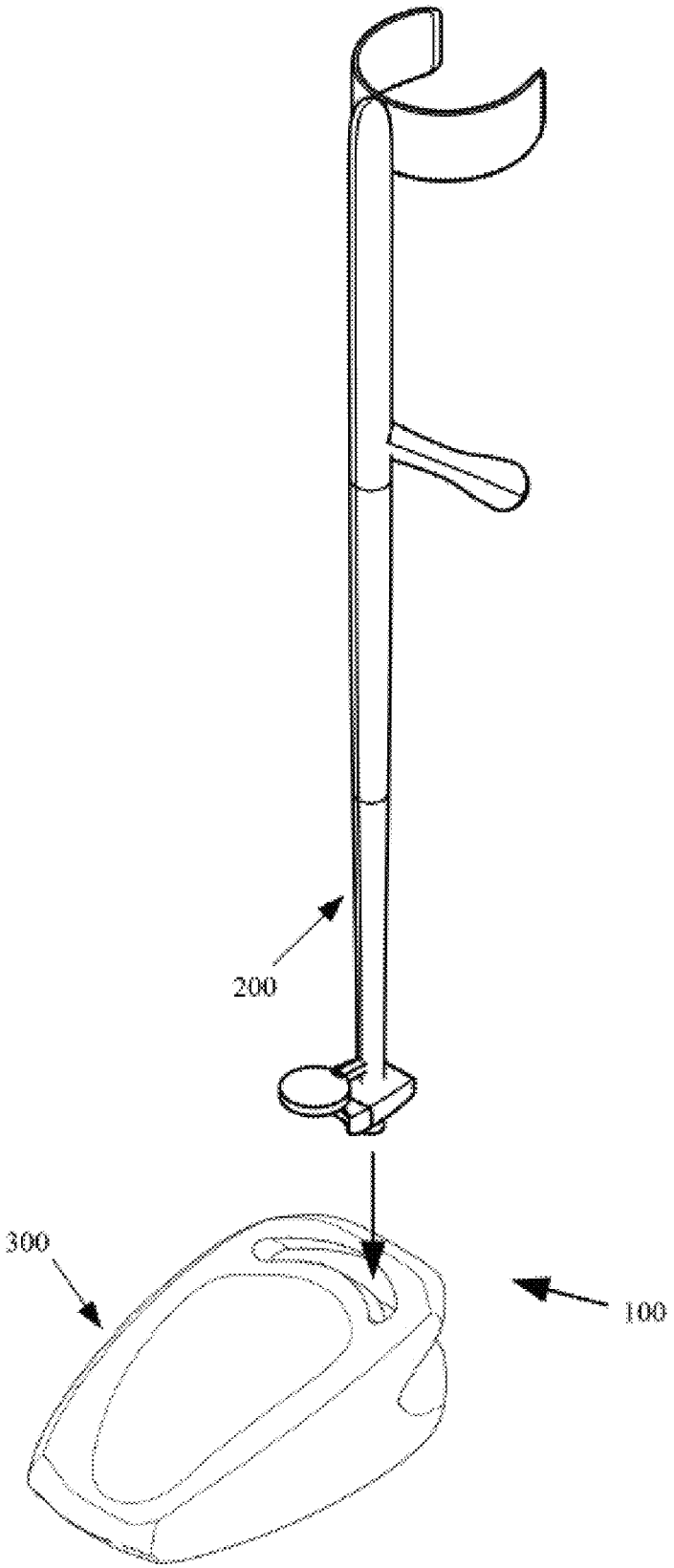
FIG. 1 is a perspective view of a first embodiment of a long-handled toenail trimmer configured to cooperate with the foot support base also shown therein.

As used throughout this specification, the word "may" is used in a permissive sense (i.e., meaning having the potential to), rather than a mandatory sense (i.e., meaning must), as more than one embodiment of the invention may be disclosed herein. Similarly, the words "include", "including", and "includes" mean including but not limited to.

Any reference made throughout this specification to "one embodiment" or "an embodiment" means that a particular feature, structure, or characteristic described in connection therewith is included in at least that one particular embodiment. Thus, the appearances of the phrases "in one embodiment" or "in an embodiment" in various places throughout this specification are not necessarily all referring to the same embodiment. Therefore, the described features, advantages, and characteristics of any particular aspect of an embodiment disclosed herein may be combined in any suitable manner with any of the other embodiments disclosed herein.

The phrases "at least one", "one or more", and "and/or" may be open-ended expressions that are both conjunctive and disjunctive in operation. For example, each of the expressions "at least one of A, B and ,C", "one or more of A, B, and C", and "A, B, and/or C" herein means all of the following possible combinations: A alone; or B alone; or C alone; or A and B together; or A and C together; or B and C together; or A, B and C together.

Any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of a multiplicity of such individual tolerances.

Any use of a friction fit (i.e., an interface fit) between two mating parts described herein indicates that the opening (e.g., a hole) is smaller than the part received therein (e.g., a shaft), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit—i.e., loose running, free running, easy running, close running, and sliding (e.g., for a 0.1250 inch shaft diameter the opening may be 0.1285 inches for a close running fit, and may be 0.1360 inches for a free running fit; for a 0.5000 inch diameter shaft the opening may be 0.5156 inches for a close running fit and may be 0.5312 inches for a free running fit). Other clearance amounts are used for other clearance types. See "Engineering Fit" at: https://en.wikipedia.org/wiki/Engineering_fit; and "Three General Types of Fit," available at www.mmto.org/dclark/Reports/Encoder%20Upgrade/fittolerences%20%5BRead-Only%5D.pdf.

As used herein, the term "hand-held" and "graspable" describes that at least one part of the toe nail trimmer is easily and conveniently held and handled by even the average small-sized human hand.

It is further noted that any use herein of relative terms such as "top," "bottom," "upper," "lower," "vertical," and "horizontal" are merely intended to be descriptive for the reader, and may be based on the depiction of those features within the figures for one particular position of the apparatus, and such terms are not intended to limit the orientation with which the disclosed toe nail trimmer may be utilized.

Also, the disclosures of all patents, published patent applications, and non-patent literature cited anywhere within this document are incorporated herein in their entirety by reference. However, it is noted that citing herein of any patents, published patent applications, and non-patent literature is not an admission as to any of those references constituting prior art with respect to the disclosed and/or claimed apparatus/method.

FIG. 1 shows a first embodiment of toenail trimming apparatus disclosed herein. The toenail trimming apparatus 100 includes a long handled trimmer 200 and a particularly configured base 300 that the long handle trimmer may cooperate with for the user to more easily and safely trim his or her toenails.

Figure 2:
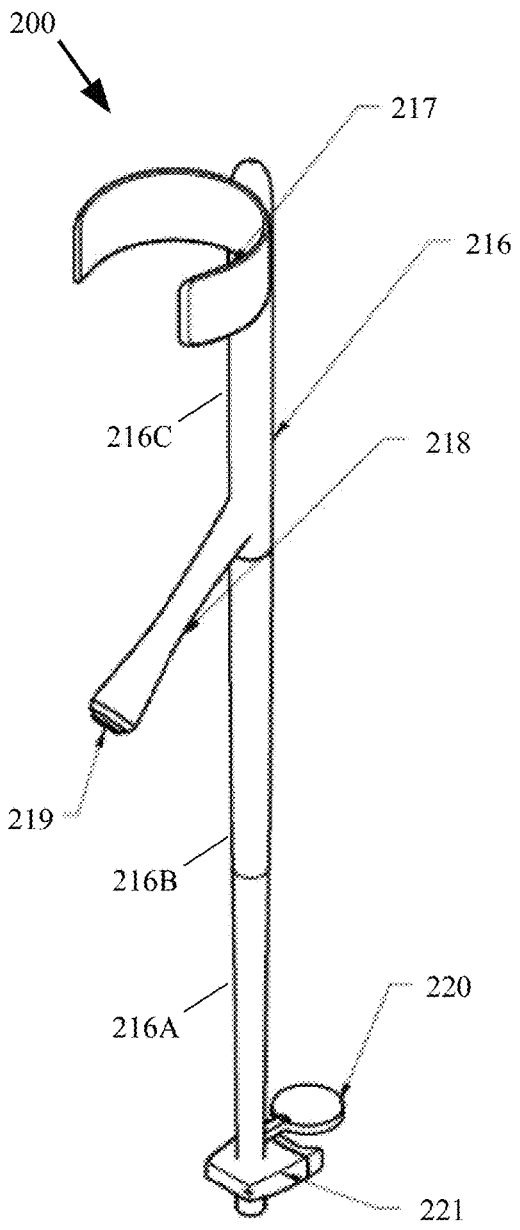
FIG. 2 is a perspective view of the long handled nail trimmer shown in FIG. 1.
Figure 3:
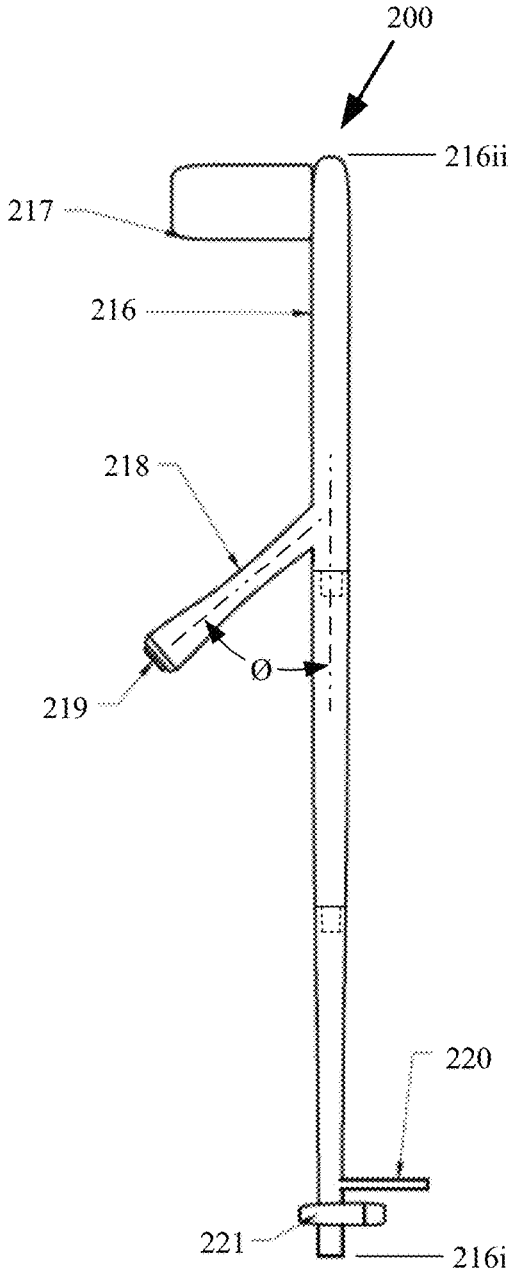
FIG. 3 is a side view of the long handled nail trimmer shown in FIG. 1.

The long handled trimmer 200 is shown in detail in FIGS. 2-3. The long handled trimmer 200 may be formed to include an extension arm 216, a motorized trimmer 221, an arm cuff 217, and a handle 218 with a handle button/switch 219.

The extension arm 216 may extend from a first end **216*i* to a second end 216*ii*, and may taper between those ends. The extension arm 216 may be a solid rigid member or may be hollow, and may be formed of any suitable material, including, but not limited to, wood, plastic, metal, composites, etc. The extension arm 216 may alternatively be formed to be broken down into segments for portability and for easier storage of the device. In one embodiment, the extension arm 216 may be formed of a plurality of hollow sections (e.g., section 216A, section 216B, and section 216C) which allows the sections to be separated to collapse, and subsequently reattach. When separated the sections 216A/216B/216C may be loosely coupled together using elastic to prevent them from scattering after the user has disconnected the sections and seeks to store the device. When assembled for use, each of the sections 216A/216B/216C of extension arm 216 may be releasably coupled together using a press fit between the inner diameter of one section and the outer diameter of the adjacent segment, or using a detent, or any other suitable apparatus to accomplish releasable such coupling that may be known in the art. These interconnected portions may each be cylindrical or may instead be formed to be conical. In another embodiment the extension arm 216** may be formed of a plurality of telescoping sections that may collapse into each other, and may be extended outward and maintained in the extended position using a detent mechanism at each interconnection. Any suitable detent mechanism may be used appropriately herein, including, but not limited to, the detent mechanism shown in U.S. Pat. No. 6,016,594 to Frey.

The motorized trimmer 221 may be positioned proximate to the first end **216*i* of the extension arm 216. As shown in detail within FIG. 4 and FIG. 5, the motorized trimmer 221 may include three portions: a power unit 26, a drive/trimmer unit 27, and a shroud 28**.

The power drive unit 26 may include an AC motor, or alternatively may include a DC motor 1 with a primary motor shaft 29, which motor may be mounted to a housing 15 that may also be configured to house a battery 12 to power the DC motor.

The drive/trimmer unit 27 may include: a bearing 3 that may be mounted to a housing plate 16; a main drive gear 4 with a primary motor shaft 29; a main drive shaft 8; a drive miter gear 5; a drive shaft gear 6; a trimmer gear 7; and a trimmer shaft 9 having a trimmer surface 10.

The shroud 28 may be formed to include a nail trimming slot 13, a quick release tab 11 that engages the housing 15 of the power drive unit 26, and a quick release pad 14 that is connected to the quick release tab 11 and may be actuated (i.e., be depressed) to cause the tab to disengage from the housing 15 when the two parts are to be separated.

The main drive gear 4 is configured to be driven by the primary motor shaft 29 of the DC motor 1. The main drive gear 4 is encased in the bearing 3 which supports the main drive gear while allowing it to spin freely. The drive miter gear 5 is mounted on the main drive shaft 8 and meshes with the main drive gear 4. The drive shaft gear 6 is also mounted on the main drive shaft 8 and meshes with trimmer gear 7 that is mounted to the shaft 9 upon which is formed the trimmer surface 10 that is configured to trim the user's nail. (Note that the ends of each of the main drive shaft 8 and the shaft 9 may be rotatably mounted to flanges protruding from the housing plate 16, which flanges are not shown in FIG. 4).

Therefore, with this mechanical arrangement the DC motor causes rotation of the primary motor shaft 29 and the main drive gear 4, which main drive gear being meshed with the drive miter gear 5 causes rotation of each of the drive miter gear and shaft 8 and drive shaft gear 6, which drive shaft gear 6 being meshed with the trimmer gear 7 causes rotation of shaft 9 and the trimmer surface 10.

The shroud 28 is coupled to the housing 15 so that the wall in which the nail trimming slot 13 is formed may be in close proximity to the trimmer surface 10 (i.e., being separated therefrom by a distance of between 0.005 inches and 0.010 inches in one embodiment, and between 0.010 inches and 0.015 inches in another embodiment, and between 0.015 inches and 0.025 inches in another embodiment, although other distance ranges or a combination of such distance ranges may also be used in other embodiments). The separation distance from the trimmer surface 10 is preferably small enough to permit sufficient trimming of the user's toenail, while being safe in terms of preventing contact of the soft tissue of the person's toes therewith, which is also prevented by the narrow height of the trimming slot 13. Accordingly, the trimmer slot 15 allows the toenail to be trimmed by trimmer surface 10 without touching the skin of the toe. In one embodiment the trimmer surface may include one or more flutes with sharp edges to abrade the toe nail. In another embodiment the trimmer surface 10 may be an abrasive surface and the shaft 9 may be similar to a grinder wheel. In yet another embodiment, the trimmer surface 10 of the motorized trimmer 221 will not cut skin because it is not sharp and abrasive; rather, the trimmer surface may have striations which are angled so that they only tend to shave the toenail.

The shroud 28 being configured for quick release and removal from engagement with the housing 15 of the power drive unit 26 permits removal and replacement of component parts of the drive/trimmer unit 27. The housing plate 16 of the drive/trimmer unit 27 may also be configured to be coupled to the power unit 26 via screws or bolts, or by a quick release mechanical means (e.g., a one-quarter turn, quick release fastener—see e.g., U.S. Pat. No. 3,145,441 to Strandrud; U.S. Pat. No. 3,247,753 to Appleberry; etc.).

The trimmer plate 16 also serves to encase the components of drive/trimmer unit 27 so that nail filings will remain contained and collected between the plate and the shroud 28 and be prevented from enter the power unit 26. The quick release feature for mounting of the shroud 28 also allows for its cleaning/sterilization between users.

The motorized trimmer 221 may be secured to the extension arm 216 in any suitable manner, including, but not limited to, be welded thereto, being mechanically fastened thereto, etc. In another embodiment, the housing 15 of the power drive unit 26 may be integrally formed with the bottom of the extension arm 216. In another embodiment that is shown in the figures the housing 15 of the power drive unit 26 may be formed with an orifice 15P (see FIGS. 4-5) that may be configured to receive a portion of the bottom of the section 216A of the extension arm.

Figure 8:
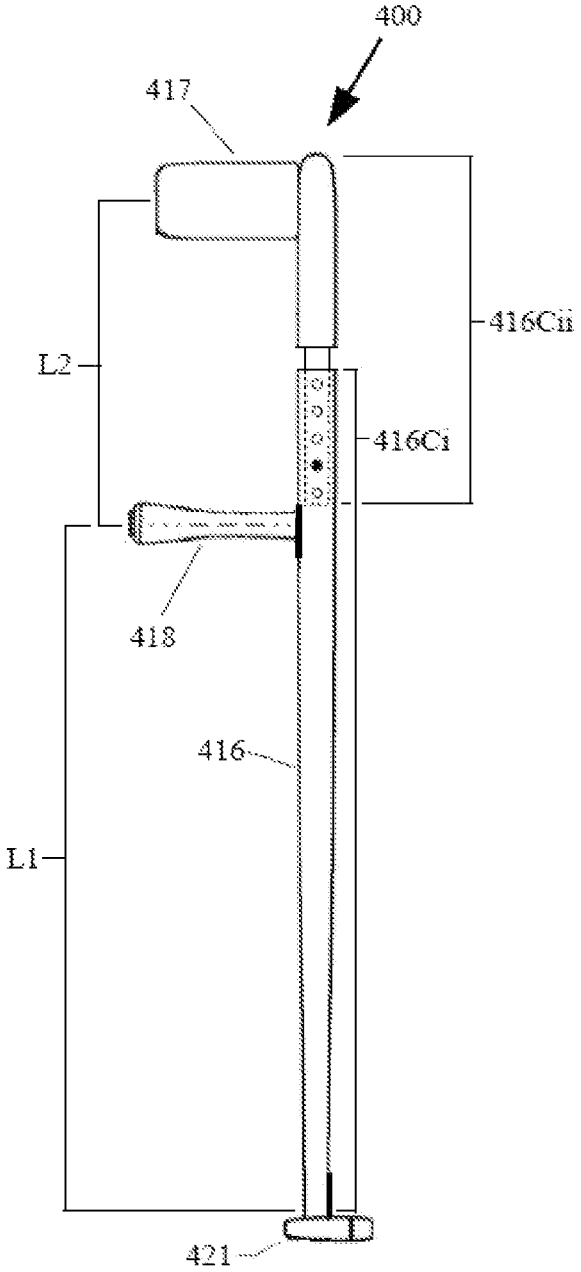
FIG. 8 is a second embodiment of a long handled nail trimmer that is used independently.

To better assist the elderly user in holding and maneuvering the long handled trimmer 200, a cuff 217 and a handle 218 are preferably incorporated into the extension arm 216. The cuff 217 can be received by, and be releasably secured to, the upper forearm or an upper arm portion of the user, while the person's hand may grasp the handle 218 to guide the motorized trimmer 221 in a much more easily controlled and very ergonomic manner (i.e., by supporting of the device at two regions). The handle 218 may extend from the extension arm 216 at an acute angle Θ to the axis of the arm, to be ergonomically grasped by the user, as shown for example in FIG. 3. In one embodiment the angle Θ may be in the range of 30 degrees to 45 degrees, and in another embodiment the angle may be in the range of 45 degrees to 60 degrees, and in another embodiment the angle may be in the range of 60 degrees to 75 degrees, and in other embodiments a combination of such ranges or a different range of other angles may alternatively be used (e.g., the handle 418 shown in FIG. 8 is oriented at about 90 degrees to the shaft). To further facilitate ease of use of the long handled trimmer 200, the operation of the DC motor (i.e., turning device on and off) may be controlled via a switch 219 that may be mounted at the end of the handle 218, and which may be toggled by the user's thumb. The switch may alternatively be positioned on the side of the handle 218 to be actuated by the user's forefinger and/or index finger similar to a trigger. Any suitable switch known in the art may be used.

Figure 6:
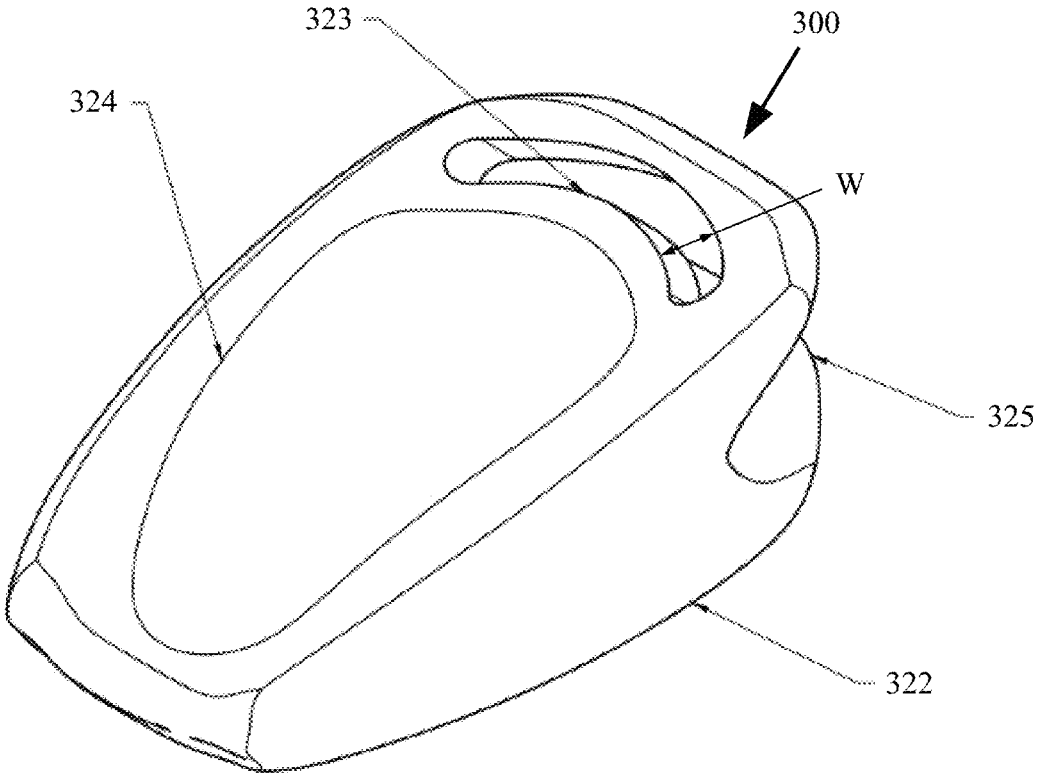
FIG. 6 is a perspective view of the base shown in FIG. 1.
Figure 7:
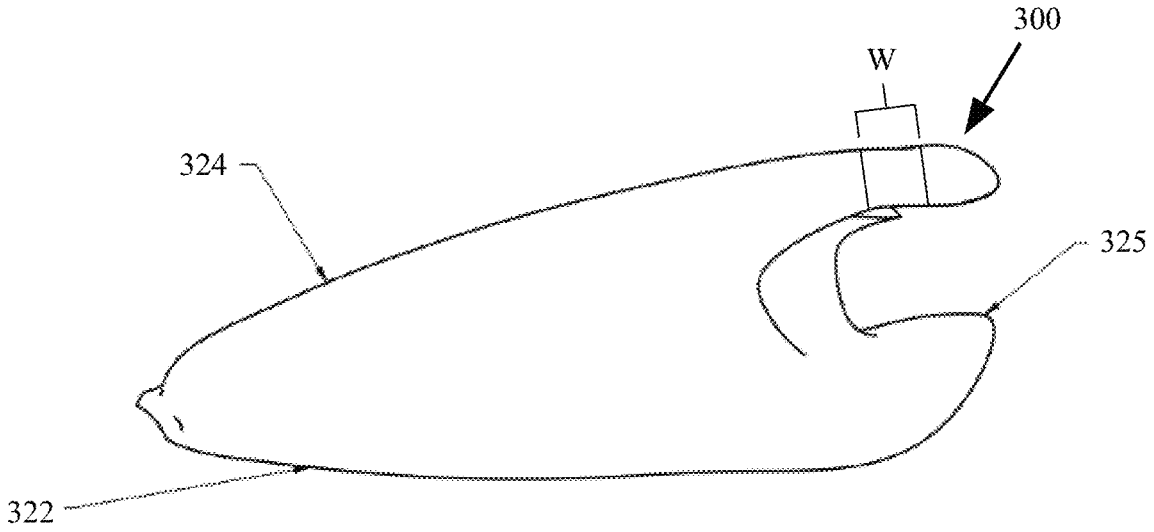
FIG. 7 is a side view of the base shown in FIG. 1.
Figure 7B:
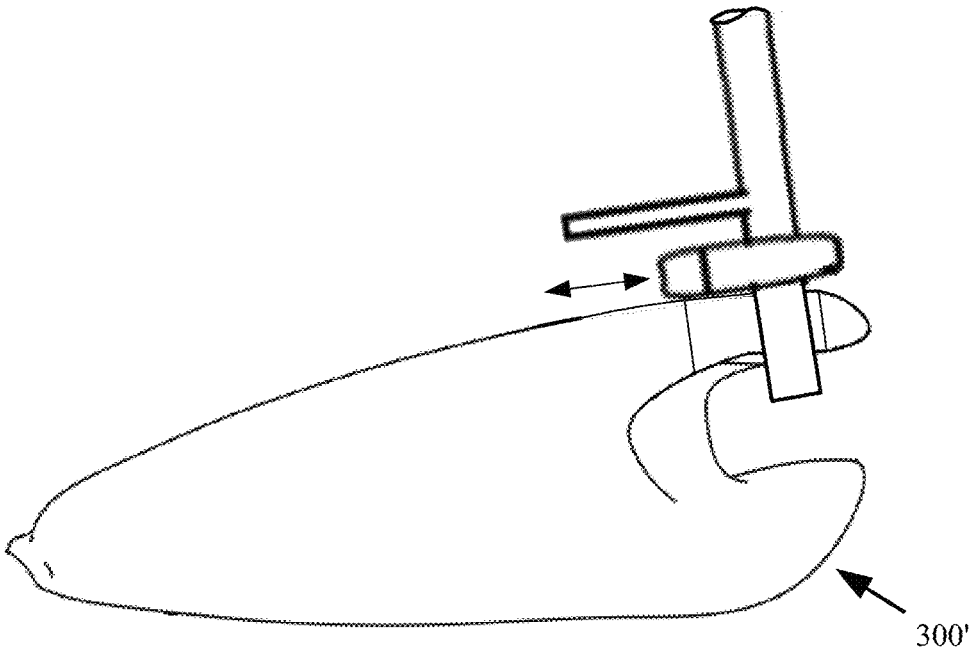
FIG. 7B is the side view of FIG. 7A, shown with a protruding portion of the shaft of the long handled trimmer received in the slot therein.

The support base 300 is shown in detail in FIGS. 6-7. The base 300 is unique and significant because it may provide additional stability for use of the long handled trimmer 200. The base 300 may further assist the elderly who tend to have far less arm motor control, which may make it difficult for them to hold the extension arm steadily enough to control the movement of the device with only their hand and arm, even with the addition of the cuff 217 and the handle 218.

The base 300 May have a foot pad 324 on an upper portion thereof that may he angled with respect to a bottom surface 322. The foot pad 324 may be a covering on top of the base to provide for extra support, comfort and grip for the user's foot, which covering be formed of any suitable material including, but not limited to: natural rubber, synthetic rubbber, etc. The base 300 may also have a slot 323 formed in the upper surface, which slot may be curved.

The base 300 may further have a recess 325 formed in the front portion to expose and interconnect with the bottom of the slot 323. The shape of the base 300 is preferably such that the front end that supports the toes is higher in elevation than the rear of the base where support is provided to the heel of the foot.

As may be understood from FIG. 1, the bottom portion of the extension arm 216 may be received in the slot 323 of the base 300. In one embodiment the top of the recess 325 (see FIG. 7) may be formed deep enough so that the first end 216*i* of the extension arm 216 may not contacted it, and the bottom of the housing 31 of the motorized trimmer 221 may contact the top of the base 300. In another embodiment, the top of the recess 325 (see FIG. 7) may be formed to a particular depth so that the first end 216*i* of the extension arm 216 does contact the base, and the bottom of the housing 31 of the motorized trimmer 221 is displaced from the top of the base 300. For either embodiment, the slot 323 provides a track for guiding/restricting the movement of the bottom of extension arm 216, to assist the user in moving the motorized trimmer 221 for trimming each of the nails on his/her toes of a foot, as it rests upon the foot pad 324 on the upper side of the base 300.

The use of low friction materials/coatings at the contact surfaces of the long handled trimmer 200 and the base 300 may further permit the elderly user to rest and lean more weight on the extension arm 216 through the arm cuff 217 and handle 218, while still being able to maneuver the device.

Figure 7A:
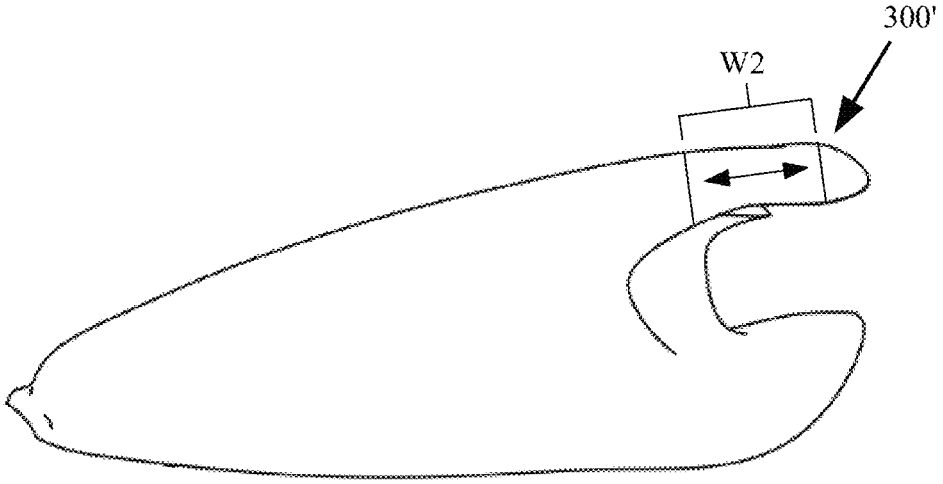
FIG. 7A is a side view of the base shown in FIG. 7, but with the curved slot shown having a larger width.

The curved shape of the slot 323 may be particularly tailored to match and accommodate only one foot geometry, as it is known that various different people have toes that may reflect his/her ancestry, including foot geometries referred to as: an Egyptian foot geometry; a Roman foot geometry; a Greek foot geometry; a Germanic foot geometry; and a Celtic foot geometry. (See e.g., "Foot Shape Ancestry: What You Toes Can Tell You," The Genealogy Bank, Nov. 15, 2018). Thus, a user may be able to select a base that matches his/her foot geometry (and may also select a base with a slot that matches the size of his/her foot). Alternatively, the shape of the slot may generalized, and may be generously oversized, whereby the width of the slot and a curved shape of the slot is formed so that it may provide sufficient clearance with respect to the bottom of the shaft protruding below the housing of the trimmer to permit the user to manipulate the long handled trimmer into contact with, and away from each toenail for various different foot geometries (compare width W for base 300 in FIGS 6-7, with width W2 in FIG. 7A for base 300').

Unlike other devices in the field, the herein disclosed apparatus is unique in that its main components need not permanently connected and can be disassembled and reassembled/reattached, making it convenient to use and then store the apparatus.

In addition, users who have reach limitations can first untold the sections of the extension arm 216 so that the arm is at its full length. Then extension arm 216 may be coupled to the base 300, which could already be on the floor, or be placed on the floor, so the user can drag and move the base to where it is conveniently positioned, now that the components are connected.

Another problem for an elderly user seeking to trim his/her toenails is straining their eves and body to be able to look more closely at their toes as they are trimming those nails. For that reason, another embodiment may also include a magnifying glass 220 positioned proximate to, but slightly above, the motorized trimmer 221 so that users can view their toes more clearly as they insert their toenails one-by-one into the trimmer slot 15 of the shroud 28 for the nails to be trimmed by trimmer surface 10.

In addition, an LED light 2 may be positioned on the motorized trimmer 221, which may also be automatically turned on whenever the trimmer is on, so that the user can more easily view their toes even in dim lighting.

Another embodiment of the disclosed apparatus is shown in FIG. 8. The long handled trimmer 400 shown in FIG. 8 may be formed the same as the long handled trimmer 200, except that the motorized trimmer 421 may be positioned at the bottom of the shaft 416, as the device is intended to be utilized without the base 300. The long handled trimmer 400 shown in FIG. 8 may be formed with a single unitary shaft member 416, or alternatively, it may be formed of three sections that may releasably couple together, similar to the long handled trimmer 200. For any of the long handled trimmer embodiments disclosed herein, the shaft (e.g., shaft 416) may have a first portion being between the trimmer 421 and the handle 418 that may be formed to have a length L1 that may accommodate a particular user (e.g., the $50^{th}$ percentile 70 year old man or woman) holding the device with the trimmer being able to reach his/her toes while sitting on a chair, with the arm generally outstretched, being bent at least somewhat at the waist. The length L1 may alternatively be a little longer to accommodate a particular user holding the long handled trimmer 400 with the trimmer 421 being able to reach his/her toes while lying down on a generally flat surface (e.g., a floor or bed), with the arm outstretched (i.e., without being bent at the waist). Different size shafts may be utilized to accommodate different sized users, and different desired modes of use (sitting or lying down). The shaft (e.g., shaft 416) may have a second portion being between the handle 418 and the support member (e.g., cuff 417) that may be formed to have a length L2 that may accommodate a particular user having his/her hand holding the handle 418 of the long handled trimmer 400, with the support member (e.g., the cuff 417) being so positioned to at least be securable to a portion of the user's forearm. The length L2 of the second portion of the shaft may alternatively be formed to be proportionately longer so that the cuff 417 may be positioned approximately midway on the upper arm of the user (i.e., midway between the elbow and the shoulder), as such positioning may accommodate a very large percentage of different sized elderly users.

Each of the herein disclosed long handle trimmer embodiments are advantageous over the prior art device, for at least the reason that they provide two points of contact with respect to the user's arm (the handle grasped by the user and the support member coupled to the arm). Also, the distance between those two points (i.e., the length L2) provides leverage for the elderly user that may not otherwise have the strength to hold a trimming device with just his/her hand for the entire time necessary to trim each of the toenails. Therefore, it may be desirable to maximize the length L2 for each user, to place the cuff 417 on the upper arm as close to the shoulder as possible for greater leverage; as such, in another embodiment, adjustability may be provided to the second shaft portion, as shown in FIG. 8, whereby the shaft 416 may be formed to have an upper shaft section 416Cii, which supports the cuff 417, that may telescope into a lower shaft section 416Ci, which supports the handle 418. The shaft sections 416Ci and 416Cii may be releasably coupled together and adjustable using detent mechanism (e.g., a spring biased ball), which may serve to increase or decrease the length L2 as needed or desired. Note that the first shaft portion may also be formed to include telescoping shaft sections and similar adjustability for the length L1.

Figure 8A:
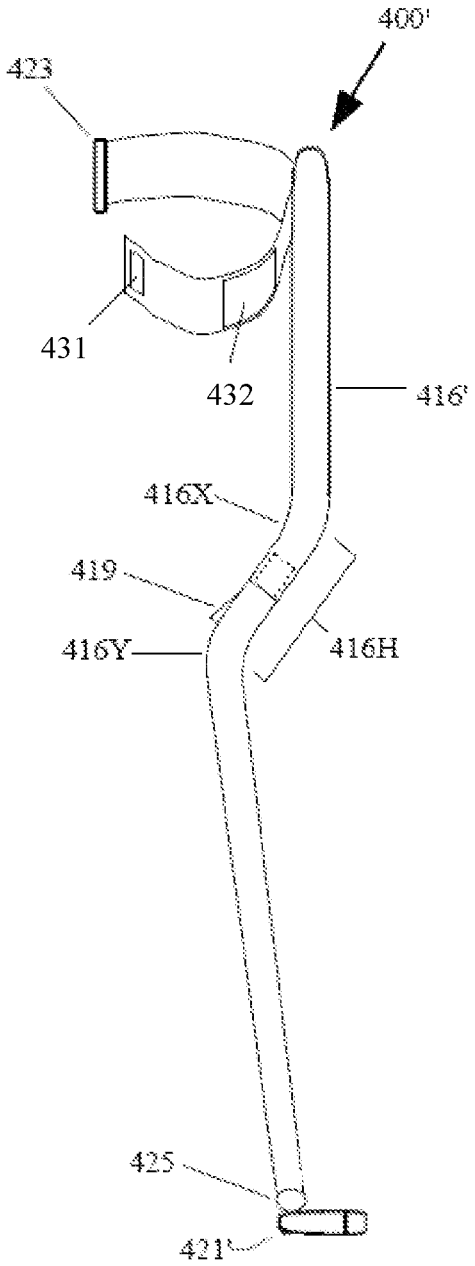
FIG. 8A illustrates another embodiment of a long-handled trimer embodiment that may be used independently, and which is formed similar to the embodiment shown in FIG. 8.

Although the long handled trimmer 400 is shown in FIG. 8 as having a shaft 416 formed to be straight—the same as the extension arm 216 for the long handled trimmer 200, and with a handle 418 that protrudes away from the extension arm 416 (both of which may nonetheless be integrally formed as a single unitary part)—a long handled trimmer 400' as seen in FIG. 8A may instead be formed without the laterally protruding handle. The long handled trimmer 400' may instead be formed with a shaft 416' that may have a first bend 416X and a second bend 416Y, which bends may form a handle portion 416H that may be ergonomically grasped by the user's hand, when the cuff is releasably secured to the user's forearm or a portion of the upper arm. The user's four fingers may wrap around that handle portion 416H of the shaft, as well as the user's thumb. The two bends 416X and 416Y may also be positioned and particularly formed, e.g., being particularly bent only in the plane of the page, and/or with at least one bend that may be out of plane of the page, to provide clearance with respect to the user's knee while the device is being used, which may be advantageous for a user who may be unable to straighten his/her legs adequately.

In this embodiment, as well as any of the above described embodiments, the device may include an on/off switch 419, which may be a push-button electrical switch where the button is biased into the off position, so that the user must apply pressure to the button (e.g., using his/her thumb) to oppose the biasing to toggle the switch into the on position, i.e., a momentary switch (see e.g., U.S. Pat. No. 3,809,839 to Beddoe). Therefore, if the user decides to stop the device, he/she may immediately release his thumb from applying pressure to the momentary switch, and it will automatically shut off the trimming apparatus.

Also, as illustrated in FIG. 8A, any of the embodiments disclosed herein may alternatively utilize other apparatus for releasably coupling the upper end of the shaft 416 to the upper end of the user's arm. For example, rather than a cuff, the shaft 416 may have one or more straps fixedly secured to the distal end. The one or more straps may be configured to be secured with respect to the user's forearm or upper arm in any suitable manner.

For example, the one or more straps may be a single strap secured to the upper end of the shaft, and which may have secured thereto a piece of hook material 431 and a piece of loop material 432 (i.e., descriptive names for such materials that are sold under the trademarked name of VELCRO®). The hook material and loop material may be positioned on the strap to releasably secure the strap to itself after being wrapped around the upper forearm (i.e., between the wrist and elbow), or a portion of the upper arm of the user (i.e., between the elbow and shoulder). Alternatively, as seen in FIG. 8A, an elongated ring 423 may be positioned on one end of the strap, and the other end of the strap may be fed through the ring and be wrapped back upon itself and then be secured using the hook and loop materials 431 and 432. In yet another embodiment, the one or more straps may include first and second straps which may respectively have hook and loop materials 431 and 432 thereon that may be similarly secured. In a further embodiment, rather than using hook and loop materials, magnets may instead be used to releasably couple the strap(s) around the user's arm. In a different embodiment, rather than using hook and loop materials or magnets, buckles may be used at the ends of the straps, which may be a buckle configured to leverage and tighten the strap similar to a ski boot buckle or a knee brace buckle (see e.g., U.S. Pat. No. 4,428,369 to Peckham). In yet another embodiment, a cuff or straps or buckles may not be utilized at all, and the upper end of the shaft may have an elastomeric band that can be drawn over the user's arm to support that end of the shaft with respect to the arm.

Also, in another embodiment, as seen in FIG. 8A, the head may be interchangeable using a coupling 424, permitting use of a larger motorized trimming head with a large opening for the big toe, and a smaller motorized trimming head with a smaller opening for the remaining toes.

Also, in yet a further embodiment, as seen in FIG. 8A, the head 421' may be coupled to the shaft using a coupling 425 that may be a pivotable. The pivotable joint 425 may permit pivoting about one axis, or two axes, or it may be a spherical coupling permitting a limited amount of pivoting of the head about multiple axes simultaneously (e.g., a cone of movement with a 5 degree to a 25 degree included angle). The pivotable head may help assist the user in positioning his or her toenail in the slot, when the device is angle, such as when holding the device in the right hand and attempting to trim the little toe of the left foot.

The cutting apparatus in the head may be battery powered or may receive power from a cord configured to be plugged into a convention wall outlet.

Figure 9:
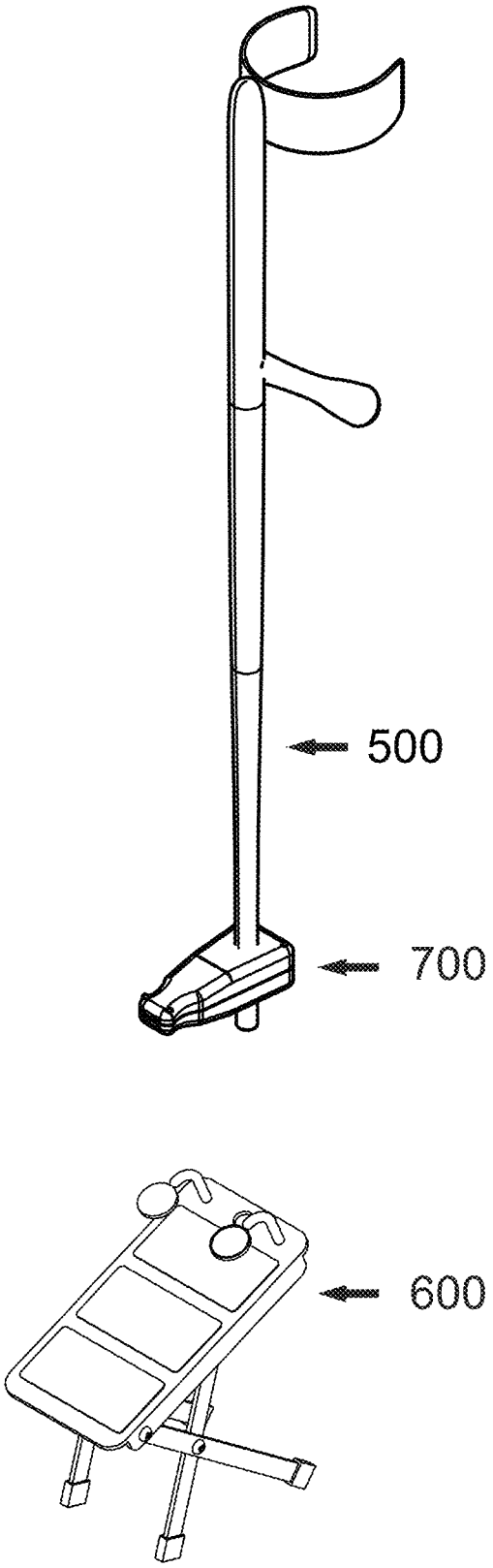
FIG. 9 is another embodiment of a long-handled trimmer with flexible belt sander and toe separators trimmer configured to cooperate with the foot support base also shown therein.
Figure 17:
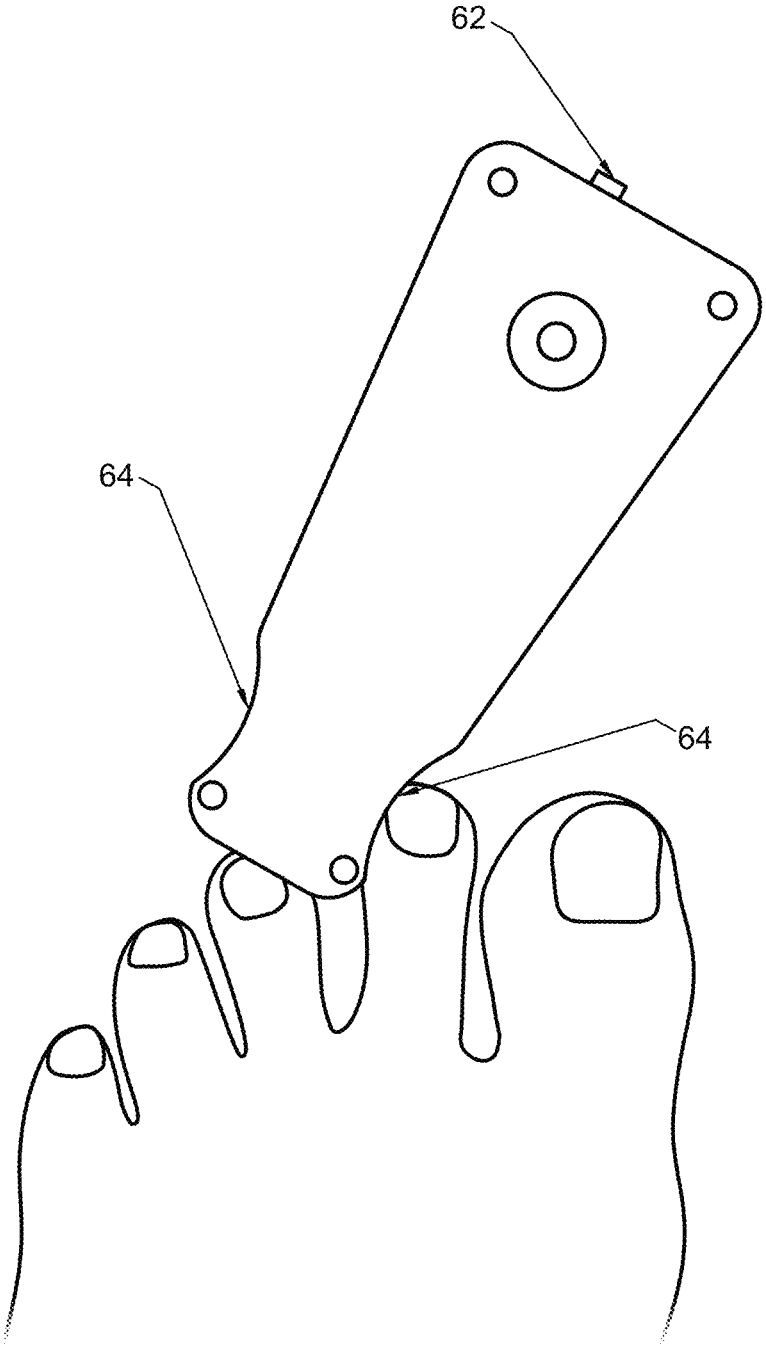
FIG. 17 is a top down view of the trimmer shown in FIG. 9, as it is being used to trim one of the toenails of a user's foot.

Another embodiment of the disclosed apparatus is shown in FIG. 9. The long handled trimmer 500 shown in FIG. 9 may be formed the same as the long handled trimmer 200, except that it may include a motorized trimmer 700 that may utilize a flexible sanding belt 55, and may have particularly contoured housing features 64, as seen in FIG. 17, that may be used to separate the user's toes. The rounded portion of the housing feature 64 may be placed against the adjacent toe, as shown in FIG. 17, and the trimmer may be rotated into contact with the toe that is to be trimmed, receiving the corresponding toenail through the opening in the housing, with the corner of the housing positioned between the two toes.

Figure 10:
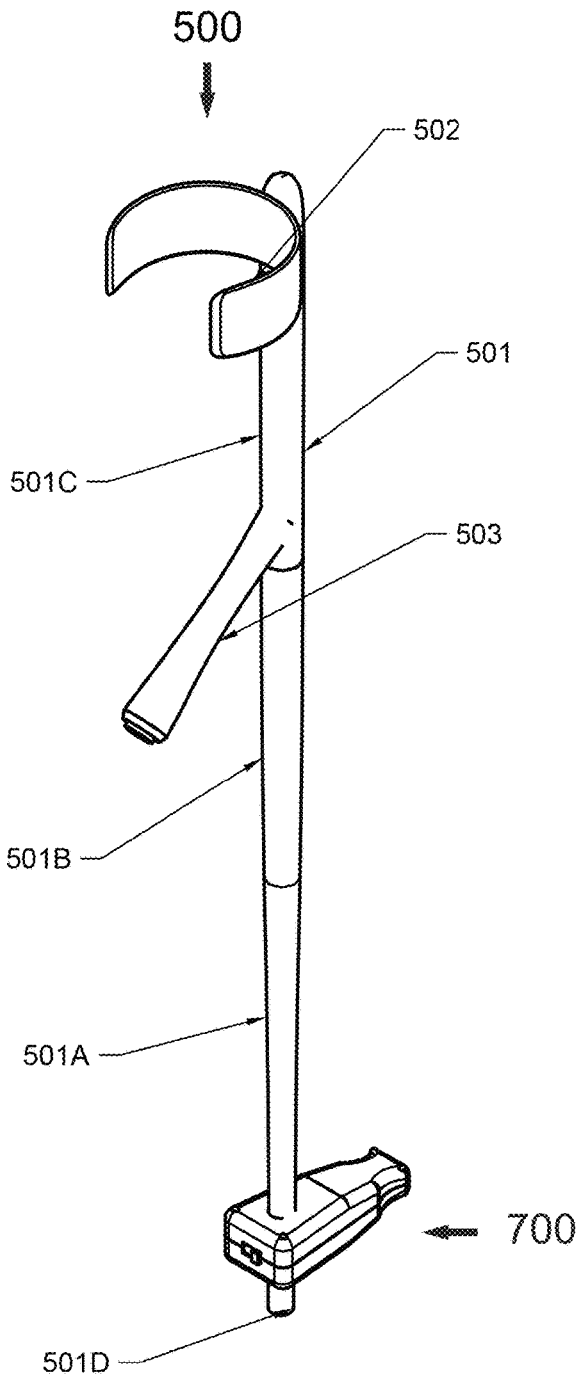
FIG. 10 is a perspective view of the long handled nail trimmer shown in FIG. 9.
Figure 11:
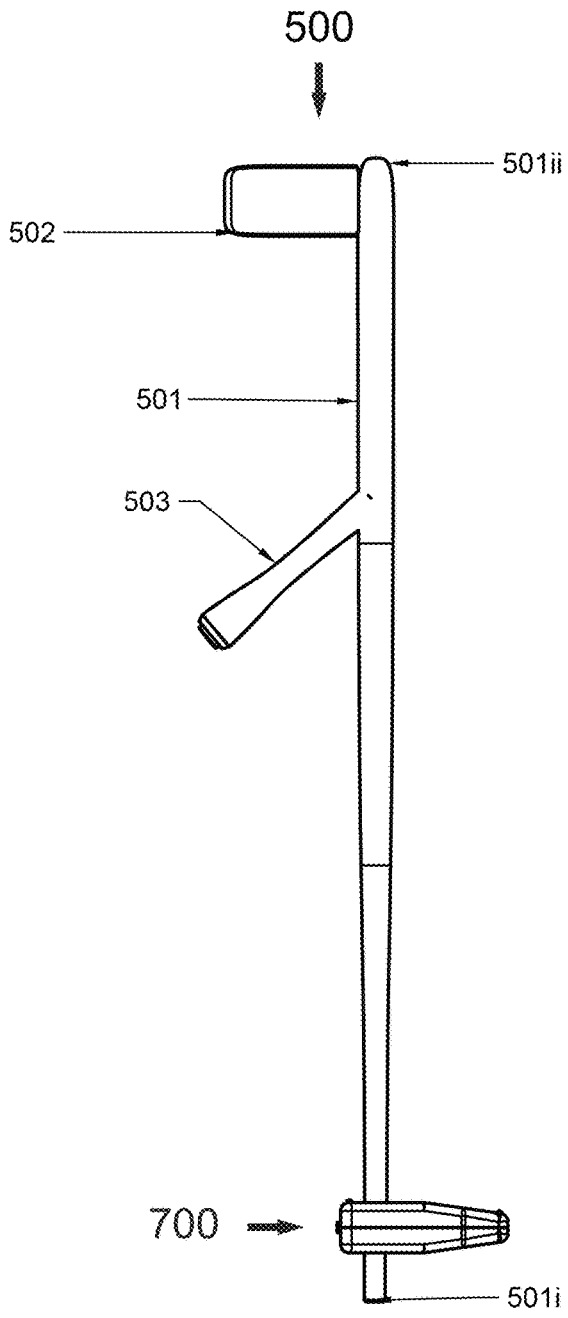
FIG. 11 is a side view of the long handled nail trimmer shown in FIG 9.
Figure 12:
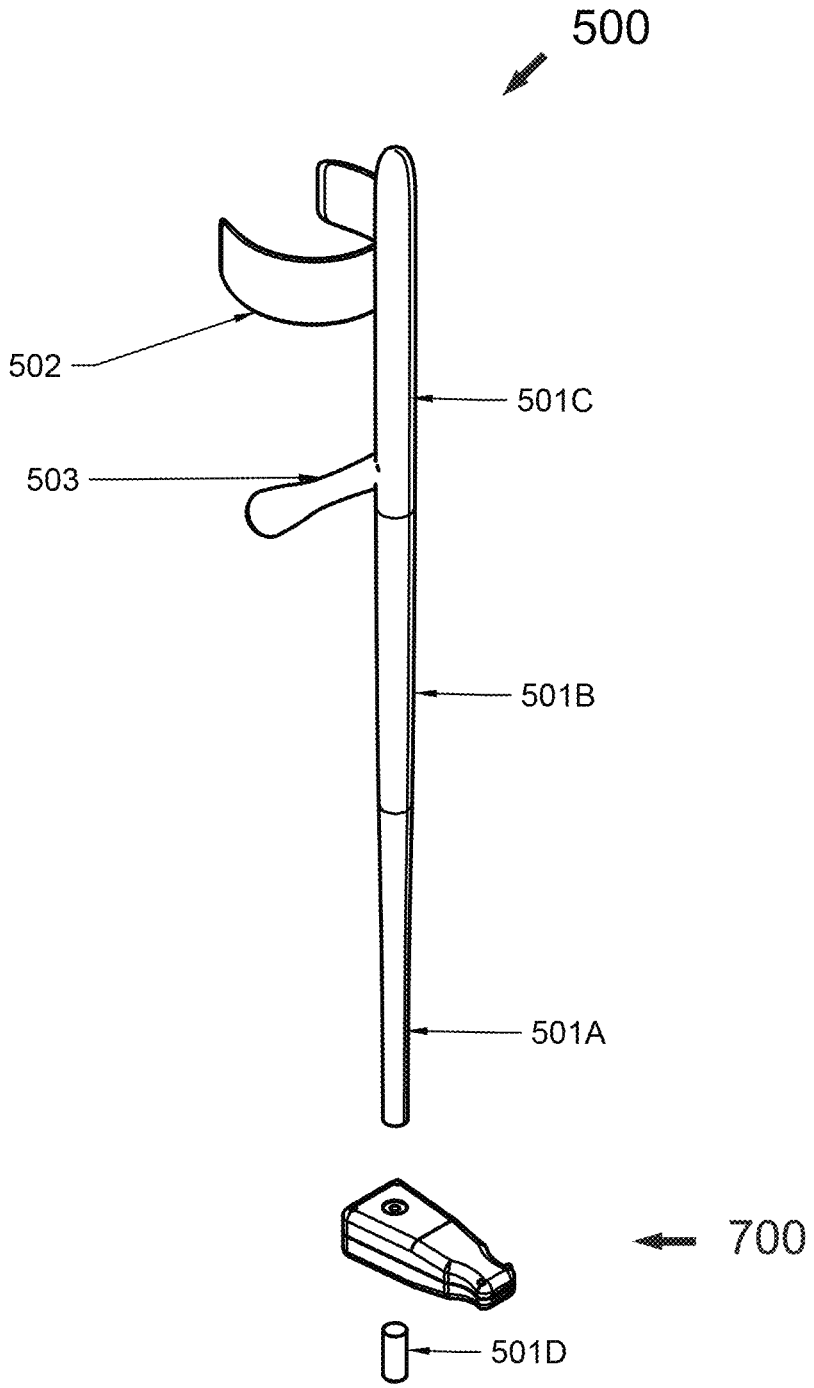
FIG. 12 is an exploded perspective view of the component parts of the long handled nail trimmer shown in FIG. 11.

The long handled trimmer 500 is shown in detail in FIGS. 10 and 11. The long handled trimmer 500 may be formed to include an extension arm 501, a motorized trimmer 700, an arm cuff 502, and a handle 503.

The extension arm 501 shares the same characteristics of the extension arm 216 in regards to extending from the first end 501*i* to the second end 501*ii*. The arm breaks down into segments for portability: the first section of the extension arm 501A, second section of the extension arm 501B, and the third section of the extension arm 501C. The fourth section of the extension arm 501D, may be attached to the bottom of the motorized trimmer 700 to form the full embodiment of the long handled trimmer 500 to slot into the hole of the base 353.

To bettor assist the user in holding and maneuvering the long handled trimmer 500, a cuff 502 and a handle 503 may be incorporated into the extension arm 501. This cuff 502 and handle 503 perform similarly to the cuff 217 and handle 218 of the long handled trimmer 200.

Figure 13:
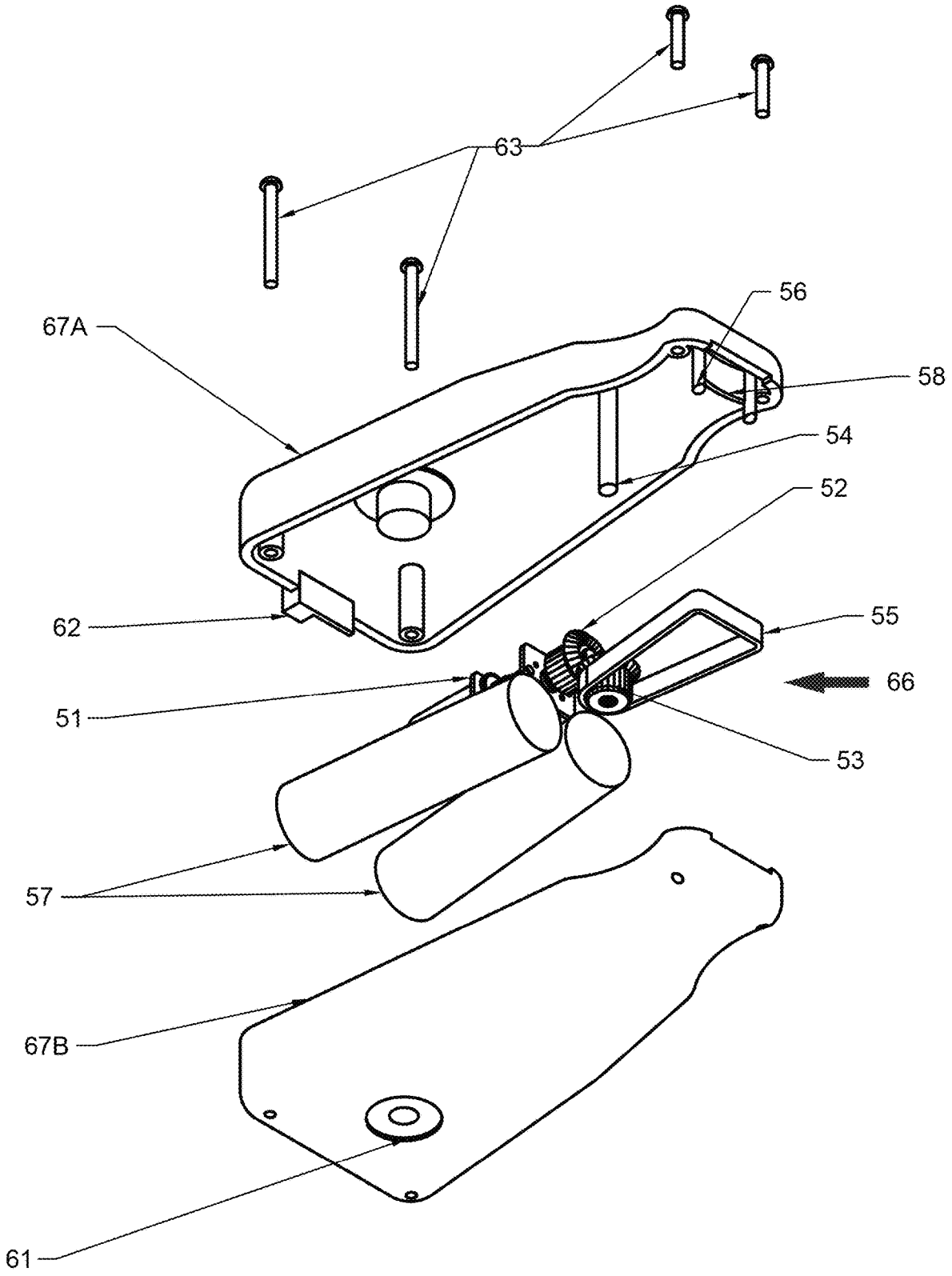
FIG. 13 is an exploded perspective view of the component parts of the motorized nail trimmer of the long handled nail trimmer device shown in FIG. 9.
Figure 14:
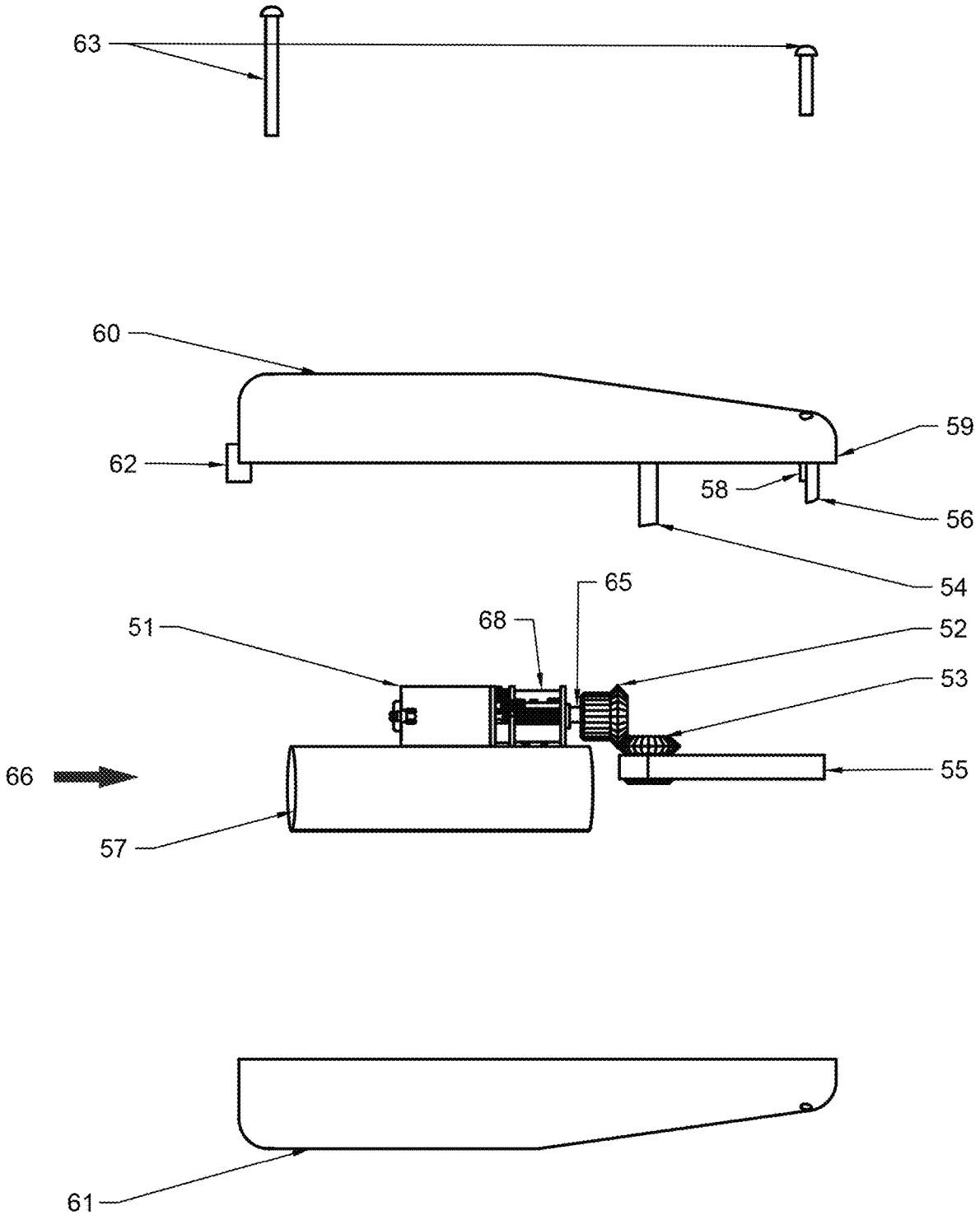
FIG. 14 is an exploded side view of the component parts shown in FIG. 12.

The motorized trimmer 700 may be positioned proximate to the first end of the extension arm. As shown in detail within FIG. 13 and FIG. 14, the motorized trimmer may include two portions: a driver/trimmer unit 66, and housing 67.

The driver/trimmer 66 unit may include a DC motor 51 with a primary motor shaft 65, and a torque geared gearbox 68. The DC motor may be powered by the battery 57, which may be in two cells. The motor may be turned on and off by a switch 62. The driver/trimmer unit may also include a main drive gear 52, and drive bevel gear 53 which actuates the flexible sanding belt 55. The path of the flexible sanding belt is defined around the drive bevel gear 53 and front belt pins 56, which may be joined by the nail support plate 58.

The main drive gear 52 is configured to be driven by the primary motor shaft 65 of the DC motor. The main drive gear 52 meshes with the drive bevel gear 53 which rotates around the driver bevel gear shaft 54 which drives the flexible sanding belt 55.

Figure 15:
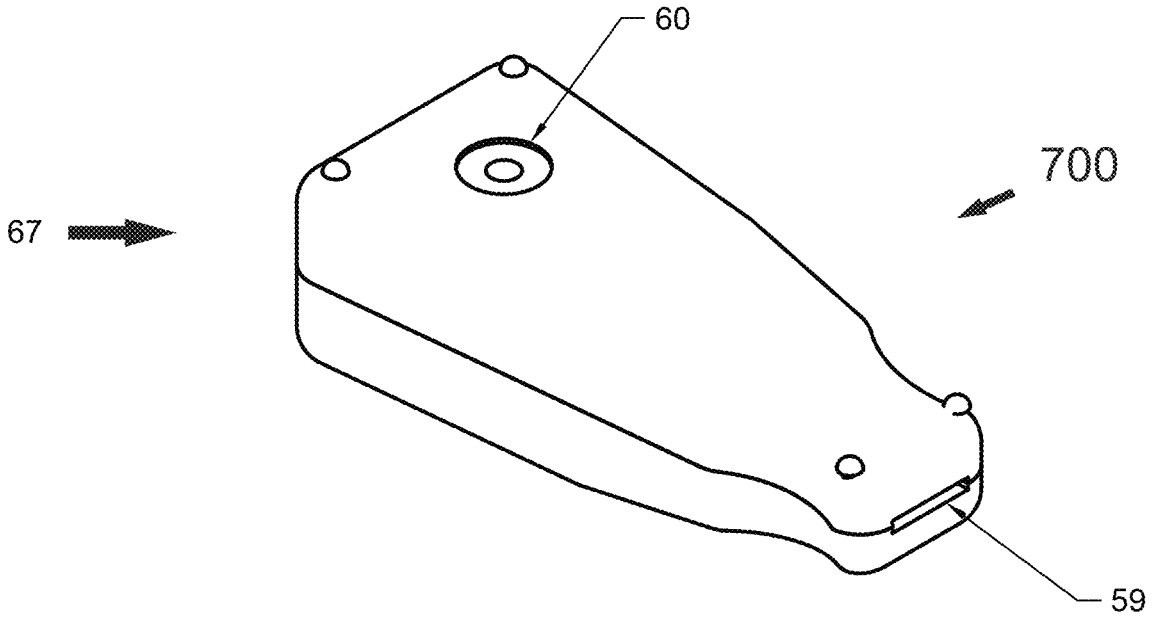
FIG. 15 is a perspective view of the trimmer shown in FIG. 9.

The housing may be made up of top portion 67A and bottom portion 67B which may be connected with screws 63 or other mechanical fasteners. The front of the housing unit may be formed to include a nail trimming slot 59, and toe separators 64 as shown in FIG. 15 and FIG. 17. The top may include a recessed indentation 60 and the bottom may include a recessed indentation 61 which may connect to the extension arm. These indentations may utilize mechanical threads or other quick release mechanisms to connect to the extension arm.

The housing is constructed so that the wall in which the nail trimming slot 59 is formed may be in close proximity to the trimmer surface (i.e., being separated therefrom by a distance of between 0.005 inches and 0.010 inches in one embodiment, and between 0.010 inches and 0.015 inches in another embodiment, and between 0.015 and 0.025 inches in another embodiment, although other distance ranges or a combination of such distance ranges may also be used in other embodiments). The separation distance from the trimmer surface is preferably small enough to permit sufficient trimming of the user's toenail, while being safe in terms of preventing contact of the soft tissue of the person's toes therewith, which is also prevented by the narrow height of the trimming slot 59. Accordingly, the trimmer slot 59 allows the toenail to be trimmed by the trimmer surface without touching the skin of the toe.

The housing permits removal and replacement of the component parts of the drive/trimmer unit.

Figure 16:
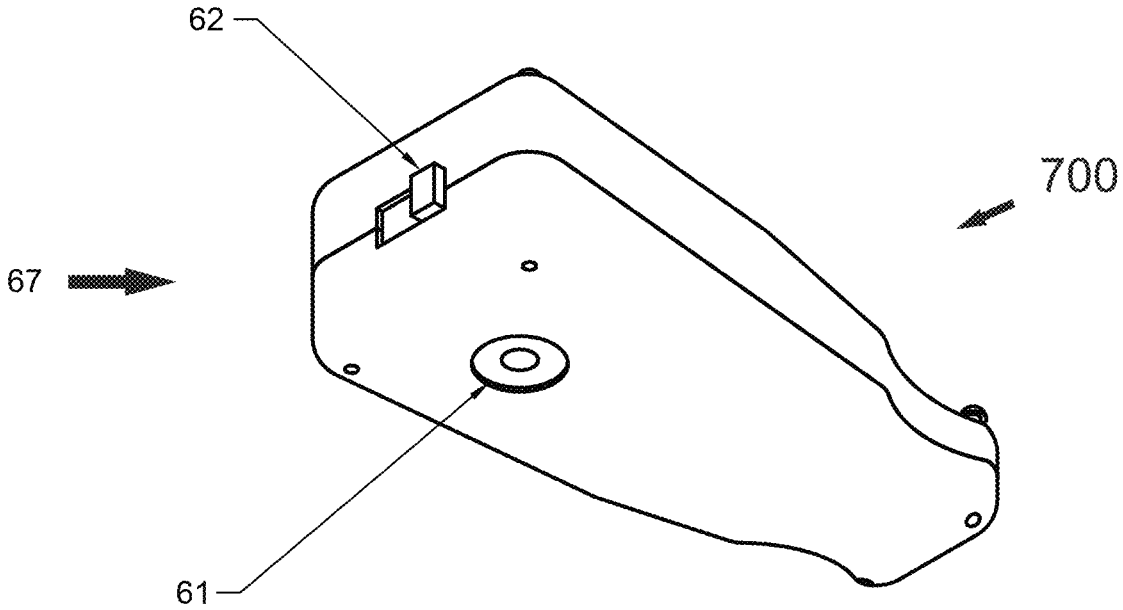
FIG. 16 is another perspective view of the trimmer shown in FIG. 9.

The motorized trimmer 700 may be secured to the extension arm 501 in any suitable manner, including, but not limited to being welded thereto, being mechanically fastened thereto, etc. In another embodiment, that is shown in the figures the housing may be formed with indentations (see FIGS. 15 and 16) to receive the extension arm from above with 501A, and below with 501D.

Figure 18:
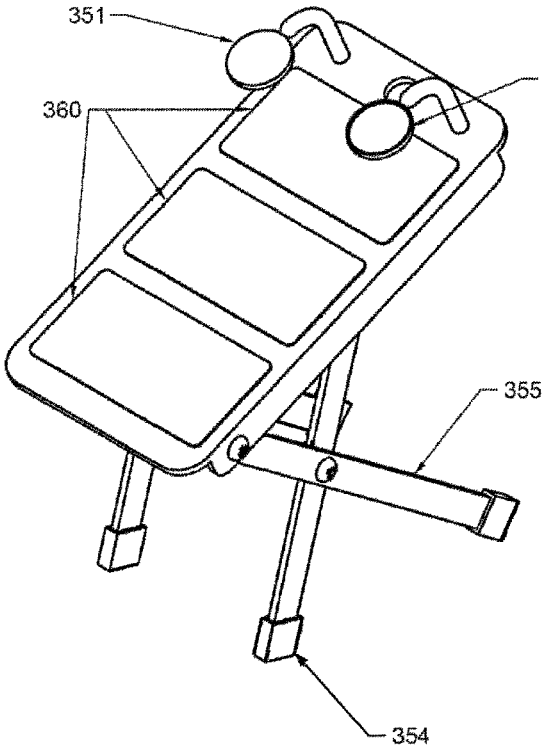
FIG. 18 is a top perspective view of the base shown in FIG. 9.
Figure 20:
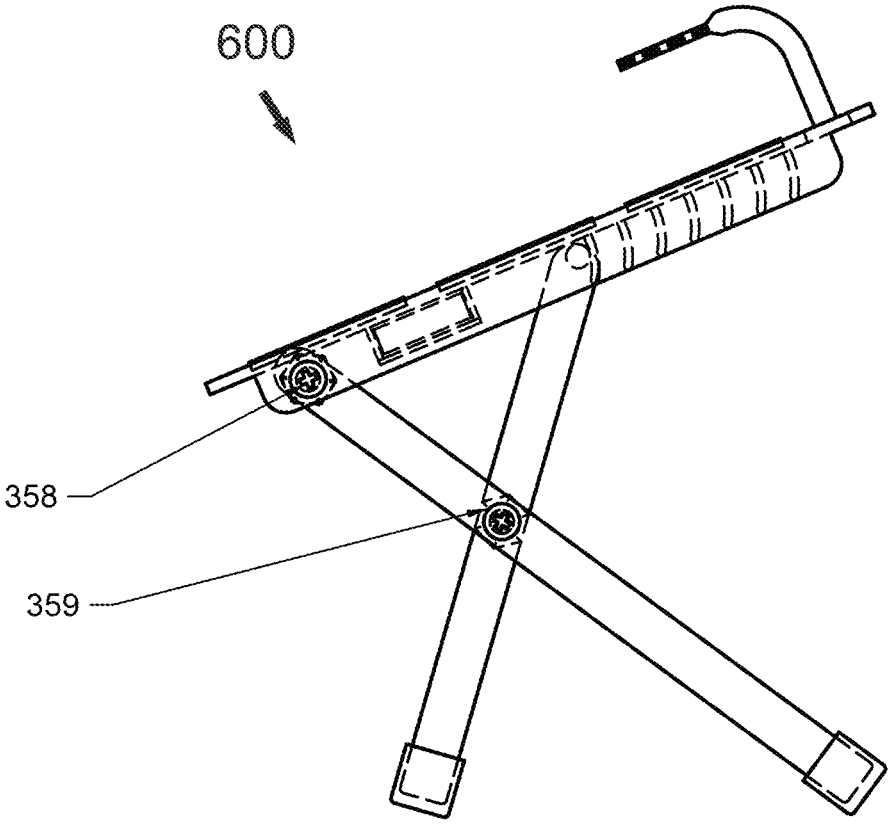
FIG. 20 is a side view of the base shown in FIG. 9.
Figure 21:
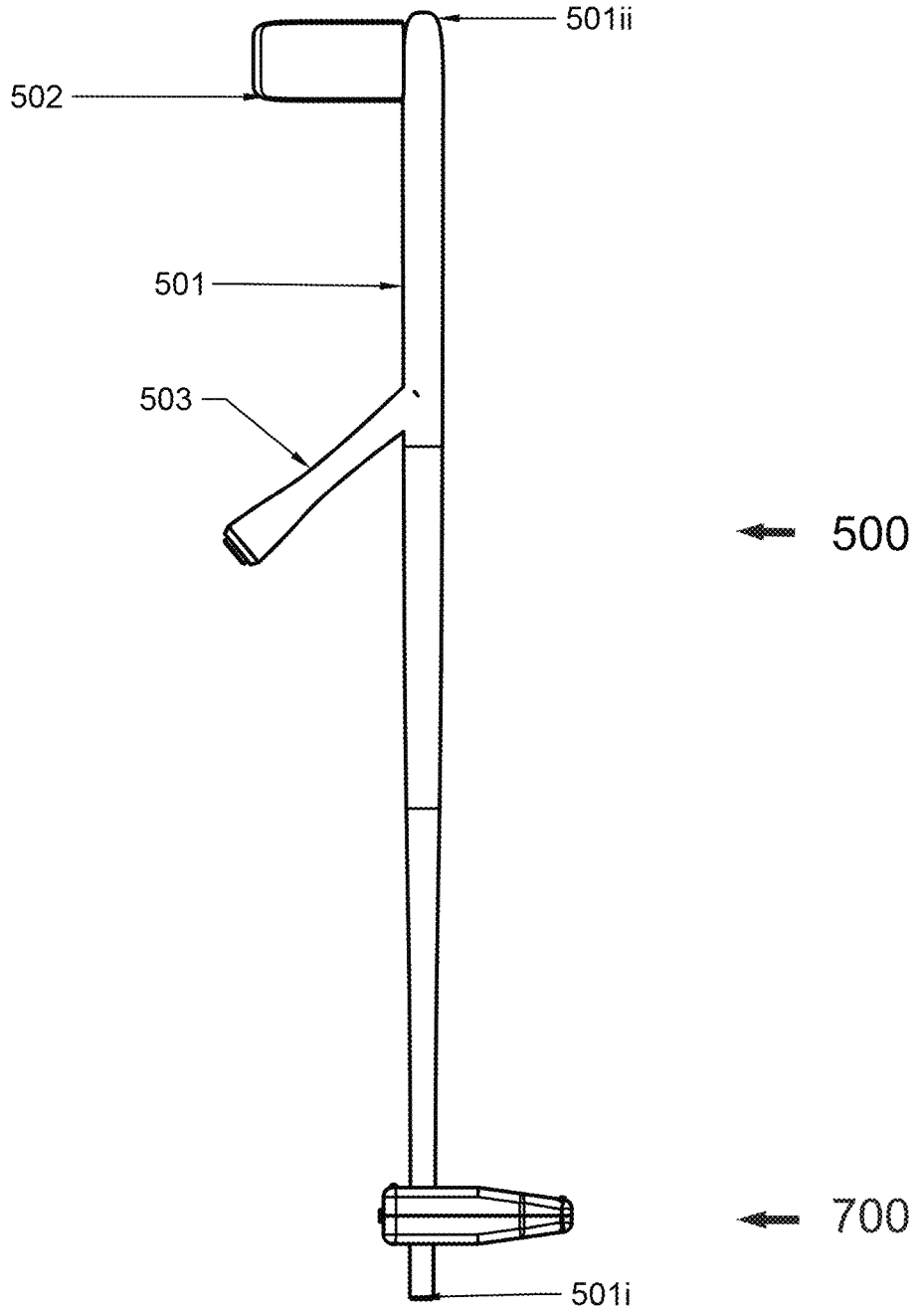
FIG. 21 is a fourth embodiment of a long handled nail trimmer that is used independently.

The support base 600 may have foot pads 360 on the upper portion thereof that may be angled with respect to the ground as shown FIG 18. The foot pads 360 may be a covering on top of the base to provide for extra support, comfort, and grip. The base 600 may also have a hole 353 formed in the upper surface, which may be elongated into the shape of a slot. The hole 353 may receive the extension arm segment 501D to form the embodiment shown in FIG 9. The base 600 may be adjustable to several heights and angles as shown in FIG. 20. The base is supported by legs 355 which pivot around the base-leg pivot point 358 and the leg-leg pivot point 359 in FIG 20. These pivot points allow the leg support beam 356 to fit into the beam teeth 361. The legs may be covered by rubber leg covers 354 to make the base more slip resistant.

Figure 19:
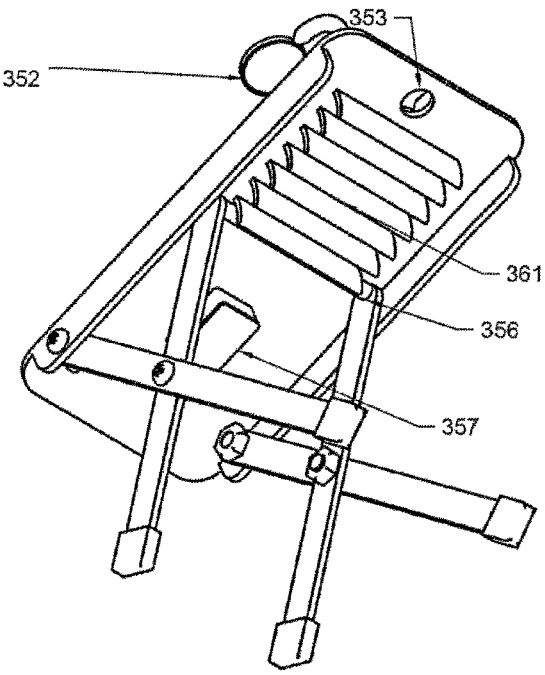
FIG. 19 is bottom perspective view of the base shown in FIG. 9.

Another embodiment may also include a magnifying glass 352 positioned above the upper surface as shown in FIG. 19. In addition, an LED light 351 may be positioned on the base to illuminate the toes and improve visibility. The LED light may be powered by a battery 357.

While illustrative implementations of one or more embodiments of the disclosed toe nail trimmer are provided hereinabove, those skilled in the art and having the benefit of the present disclosure will appreciate that further embodiments may be implemented with various changes within the scope of the disclosed toe nail trimmer. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A toe nail trimmer system comprising:

a toe nail trimmer, said toe nail trimmer comprising:

a shaft; a portion of said shaft configured to be grasped by a user to support said toe nail trimmer; said shaft comprising a protrusion protruding from a bottom portion thereof;

a motor;

a trimming member, said trimming member configured to be actuated by said motor to remove a portion of a toenail;

a base member; a bottom surface of said base member configured to rest upon a floor surface; a top surface of a first portion of said base member configured to support a foot of the user; said base member comprising a curved slot configured to receive and guide said protrusion of said shaft of said toe nail trimmer, and permit said protrusion to slide with respect to said curved slot to position said trimming member in proximity to a plurality of toe nails for trimming of the toe nails by said trimming member;

wherein said curved slot is formed in said top surface of said first portion of said base, and is centrally positioned with respect to a first side and a second side of said base; and wherein said curved slot forms an enclosed area configured to limit travel of said protrusion when received therein.

2. The toe nail trimmer according to claim 1, wherein a shape of said slot is formed to accommodate a particular foot geometry from the group of foot geometries consisting of: an Egyptian foot geometry; a Roman foot geometry; a Greek foot geometry; a Germanic foot geometry; and a Celtic foot geometry.

3. The toe nail trimmer according to claim 1, wherein a width of said slot and a shape of said slot is formed to accommodate a plurality of different foot geometries.

4. A toe nail trimmer system comprising:

a base member;

a toe nail trimmer, said toe nail trimmer comprising:

a shaft; a portion of said shaft configured to be grasped by a user to support said toe nail trimmer;

a motor;

a trimming member, said trimming member configured to be actuated by said motor to remove a portion of a toenail; and means for releasably interconnecting with said base member; and wherein said base member comprises: a bottom surface, said bottom surface of said base member configured to rest upon a floor surface; a top surface, a first portion of said top surface of said base member configured to support a foot of the user; and said base member further comprising means for receiving and guiding and limiting travel of said means for releasably interconnecting of said toe nail trimmer, permitting sliding with respect to said means for engaging and supporting and guiding, of said means for releasably interconnecting for positioning said trimming member in proximity to one or more toe nails of a user, and trimming of each of the one or more toe nails by said trimming member of said toe nail trimmer:

wherein said means for receiving and guiding and limiting travel is formed in said top surface of said first portion of said base, and is centrally positioned with respect to a first side and a second side of said base.

5. The toe nail trimmer system according to claim 4, further comprising a switch configured to turn said motor on and off.

6. The toe nail trimmer system according to claim 4, wherein said cutting member comprises a sharp-edged cutting tool.

7. The toe nail trimmer system according to claim 4, wherein said cutting member comprises a belt of sand paper configured to rotate upon two or more rollers.

8. The toe nail trimmer system according to claim 4, wherein said cutting member comprises a rotatable abrasive shaft.

* * * * *